US009409742B2

(12) United States Patent
Shirasaki et al.

(10) Patent No.: US 9,409,742 B2
(45) Date of Patent: Aug. 9, 2016

(54) POST-PROCESSING DEVICE CONTROLLING ACCUMULATION OF SHEET ONTO PROCESSING TRAY ACCORDING TO POSITION OF STACK TRAY AND IMAGE FORMING SYSTEM INCLUDING THIS POST-PROCESSING DEVICE

(71) Applicant: KYOCERA Document Solutions Inc., Osaka (JP)

(72) Inventors: Seiichi Shirasaki, Osaka (JP); Takeshi Matsuo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 79 days.

(21) Appl. No.: 14/527,998

(22) Filed: Oct. 30, 2014

(65) Prior Publication Data

US 2015/0151944 A1 Jun. 4, 2015

(30) Foreign Application Priority Data

Dec. 3, 2013 (JP) ..... 2013-250017

(51) Int. Cl.

*B65H 37/04* (2006.01)
*B65H 43/08* (2006.01)
*B65H 29/12* (2006.01)
(Continued)

(52) U.S. Cl.

CPC ..... *B65H 43/08* (2013.01); *B65H 29/125* (2013.01); *B65H 29/14* (2013.01); *B65H 31/10* (2013.01); *B65H 31/3027* (2013.01); *B65H 2301/4213* (2013.01); *B65H 2511/20* (2013.01); *B65H 2511/51* (2013.01); *B65H 2511/515* (2013.01); *B65H 2513/512* (2013.01); *B65H 2513/514* (2013.01); *B65H 2553/412* (2013.01); *B65H 2801/06* (2013.01)

(58) Field of Classification Search

CPC ..... B65H 37/04; B65H 43/00; B65H 43/06; B65H 43/08; B65H 7/14
USPC ..... 270/58.09, 58.11
See application file for complete search history.

(56) References Cited

U.S. PATENT DOCUMENTS 5,320,336 A * 6/1994 Asami ..... B42C 1/12 270/58.08
6,003,861 A * 12/1999 Iizumi ..... B42C 1/12 271/215
6,375,181 B1 * 4/2002 Kawano ..... B65H 29/58 270/58.12

(Continued)

FOREIGN PATENT DOCUMENTS

JP 2001-010763 A 1/2001
JP 2001010763 A * 1/2001

*Primary Examiner* — Patrick Mackey
(74) *Attorney, Agent, or Firm* — Studebaker & Brackett PC

(57) ABSTRACT

A post-processing device includes a device main body, a processing tray, a placed sheet processing part, a stack tray, a detecting part, a stack tray driving part and a sheet conveying part. The processing part carries out post-process to the sheet placed on the processing tray. The stack tray stacks the sheet ejected from a sheet ejection port. The detecting part detects whether or not the stack tray or the sheet on the stack tray is positioned at a detected position below the sheet ejection port. When the sheet is ejected without the post-process, in a detectable case, the conveying part ejects the sheet without placing on the processing tray and, in an undetectable case, the conveying part places the sheet on the processing tray without ejecting to the stack tray until it becomes detectable, and then, ejects the sheet on the processing tray after it becomes detectable.

8 Claims, 7 Drawing Sheets

(51) Int. Cl.

| | |
|---|---|
| ***B65H 29/14*** | (2006.01) |
| ***B65H 31/10*** | (2006.01) |
| ***B65H 31/30*** | (2006.01) |

(56) References Cited

U.S. PATENT DOCUMENTS

| | | | | |
|---|---|---|---|---|
| 6,631,896 | B2 * | 10/2003 | Yamada | B65H 39/11 270/58.09 |
| 7,325,800 | B2 * | 2/2008 | Brown | B65H 43/06 270/52.06 |
| 7,690,637 | B2 * | 4/2010 | Yamamoto | B65H 31/26 270/58.07 |
| 7,798,481 | B2 * | 9/2010 | Terao | B65H 31/10 270/58.04 |
| 7,992,856 | B2 * | 8/2011 | Saito | B65H 31/3027 270/58.08 |
| 8,109,497 | B2 * | 2/2012 | Okamoto | B65H 37/04 270/20.1 |
| 8,123,209 | B2 * | 2/2012 | Kubota | B42C 1/12 270/58.07 |
| 8,262,086 | B2 * | 9/2012 | Kitazawa | B65H 37/04 271/213 |
| 2006/0261543 | A1 * | 11/2006 | Miyake | B65H 31/24 271/292 |
| 2014/0061993 | A1 * | 3/2014 | Shimura | B65H 39/00 270/58.09 |

* cited by examiner

POST-PROCESSING DEVICE CONTROLLING ACCUMULATION OF SHEET ONTO PROCESSING TRAY ACCORDING TO POSITION OF STACK TRAY AND IMAGE FORMING SYSTEM INCLUDING THIS POST-PROCESSING DEVICE

INCORPORATION BY REFERENCE

This application is based on and claims the benefit of priority from Japanese Patent application No. 2013-250017 filed on Dec. 3, 2013, the entire contents of which are incorporated herein by reference.

BACKGROUND

The present disclosure relates to a post-processing device performing post-processes to a sheet outputted from an image forming apparatus or the like, and an image forming system including this post-processing device.

A post-processing device is connected to an image forming apparatus, such as a copying machine or a printer, to carry-in a sheet outputted from the image forming apparatus after an image is formed on the sheet in the image forming apparatus and to perform post-processes, such as punching process, stapling process and others, to the sheet. The post-processing device temporarily accumulates the carried-in sheet on a process tray and aligns end parts of a predetermined number of the sheets by the process tray, and then, performs the post-processes, such as the stapling process, to these sheets and ejects the post-processed sheet onto a stack tray. There is also a post-processing device lowering the stack tray as the sheet is ejected onto the stack tray.

The post-processing device lowers the stack tray in accordance with the ejection of the sheet, not only when ejecting every the predetermined number of the sheets placed on the process tray to the stack tray, but also when ejecting every one sheet to the stack tray. Thereby, the sheet ejected from an ejection port of the post-processing device is stacked at a top face position of the stack tray or at an uppermost position of the sheets stacked on the stack tray. The stack tray is raised and returned to an original position when all the sheets on the stack tray are taken out.

However, for example, a time required for raising the stack tray from a lower side to an upper side in its movement path is lengthened compared with a time required for performing the post-processes of one sheet. In the above-mentioned post-processing device, in the middle of the post-processes of many sheets, if the entirety or a part of the sheets stacked on the stack tray are/is taken out, the following post-processed sheet is ejected even through the stack tray is not returned to the original position, i.e. located at the lower side. At this time, because the sheet is ejected in the air above the top face position of the stack tray or the uppermost position of the sheets stacked on the stack tray, the sheet is not suitably stacked and a trouble, such as dropping out from the stack tray, occurs.

By contrast, there is a finisher as the post-processing device temporarily accumulating a plurality of sheets outputted from an image forming apparatus on a post-process tray part, performing post-processes to a sheaf of the sheets, and stacking the post-processed sheet sheaf onto a stack tray part (a stack tray) lowering in accordance with carrying-in or stacking of the sheet sheaf. The finisher includes a sheet sheaf stack detecting sensor detecting the sheet on the stack tray part and an elevating function raising the stack tray part to an original position when the sheet sheaf stack detecting sensor detects that the sheet is taken out from the stack tray part. The finisher makes the sheet sheaf wait in the middle of conveyance to the stack tray part until the stack tray part is returned back to the original position after the sheet sheaf on the stack tray part is taken out. The finisher also resumes the conveyance of the sheet sheaf after the return of the stack tray part to the original position.

However, in the post-processing device as the above-mentioned finisher, the sheet sheaf stack detecting sensor detects whether or not the sheet is placed on the stack tray. According to this, when a part of the plurality of the sheets on the stack tray is taken out, the sheet sheaf stack detecting sensor cannot detect the taking-out of the part of the sheets. Therefore, in such a case, because the elevating function does not raise the stack tray, it is impossible to suitably stack the post-processed sheets on the stack tray.

In the above-mentioned post-processing device, when the entire sheets on the stack tray are taken out in the middle of the post-processes of many sheets, it is necessary to stop outputting the sheet from the image forming apparatus and to stop the post-processes of the post-processing device until the stack tray located at the lower side is raised to the original position. The stopping of works, such as the post processes, during the raising time of the stack tray causes waste of working time.

SUMMARY

In accordance with an embodiment of the present disclosure, a post-processing device includes a device main body, a processing tray, a placed sheet processing part, a stack tray, a detecting part, a stack tray driving part and a sheet conveying part. The device main body includes a sheet ejection port used for ejecting a sheet. The processing tray is arranged inside the device main body, on which the sheet is temporarily placed. The placed sheet processing part carries out post-process to the sheet in a state of being placed on the processing tray. The stack tray is arranged in the device main body to stack the sheet ejected from the sheet ejection port. The detecting part is arranged in the device main body to detect whether or not a top face of the stack tray or a top face of the sheet stacked on the stack tray is positioned at a detected position below the sheet ejection port. The stack tray driving part is configured so as to move downwardly the stack tray until the detecting part cannot detect the stack tray or the sheet stacked on the stack tray, when the sheet is ejected from the sheet ejection port, and then, to move upwardly the stack tray until the detecting part detects the top face of the stack tray or the top face of the sheet stacked on the stack tray. The stack tray driving part also moves upwardly the stack tray in a case where the detecting part does not detect the stack tray or the sheet stacked on the stack tray, when ejecting the sheet. The sheet conveying part is configured, when the sheet is ejected without the post-process by the placed sheet processing part, in a case where the detecting part detects the stack tray or the sheet stacked on the stack tray, so as to eject the sheet from the sheet ejection port without placing on the processing tray. The sheet conveying part also is configured, when the sheet is ejected without the post-process by the placed sheet processing part, in another case where the detecting part does not detect the stack tray or the sheet stacked on the stack tray, to stop the ejection of the sheet to the stack tray and to place the sheet on the processing tray until the detecting part detects the stack tray or the sheet stacked on the stack tray, and then, to eject the sheet placed on the processing tray from the sheet ejection port to the stack tray after the detecting part detects the stack tray or the sheet stacked on the stack tray.

In accordance with an embodiment of the present disclosure, an image forming system includes an image forming apparatus performing image forming process to a sheet and a post-processing device. the post-processing device includes a device main body, a processing tray, a placed sheet processing part, a stack tray, a detecting part, a stack tray driving part and a sheet conveying part. The device main body includes a sheet ejection port used for ejecting a sheet. The processing tray is arranged inside the device main body, on which the sheet is temporarily placed. The placed sheet processing part carries out post-process to the sheet in a state of being placed on the processing tray. The stack tray is arranged in the device main body to stack the sheet ejected from the sheet ejection port. The detecting part is arranged in the device main body to detect whether or not a top face of the stack tray or a top face of the sheet stacked on the stack tray is positioned at a detected position below the sheet ejection port. The stack tray driving part is configured so as to move downwardly the stack tray until the detecting part cannot detect the stack tray or the sheet stacked on the stack tray, when the sheet is ejected from the sheet ejection port, and then, to move upwardly the stack tray until the detecting part detects the top face of the stack tray or the top face of the sheet stacked on the stack tray. The stack tray driving part also moves upwardly the stack tray in a case where the detecting part does not detect the stack tray or the sheet stacked on the stack tray, when ejecting the sheet. The sheet conveying part is configured, when the sheet is ejected without the post-process by the placed sheet processing part, in a case where the detecting part detects the stack tray or the sheet stacked on the stack tray, so as to eject the sheet from the sheet ejection port without placing on the processing tray. The sheet conveying part also is configured, when the sheet is ejected without the post-process by the placed sheet processing part, in another case where the detecting part does not detect the stack tray or the sheet stacked on the stack tray, to stop the ejection of the sheet to the stack tray and to place the sheet on the processing tray until the detecting part detects the stack tray or the sheet stacked on the stack tray, and then, to eject the sheet placed on the processing tray from the sheet ejection port to the stack tray after the detecting part detects the stack tray or the sheet stacked on the stack tray.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
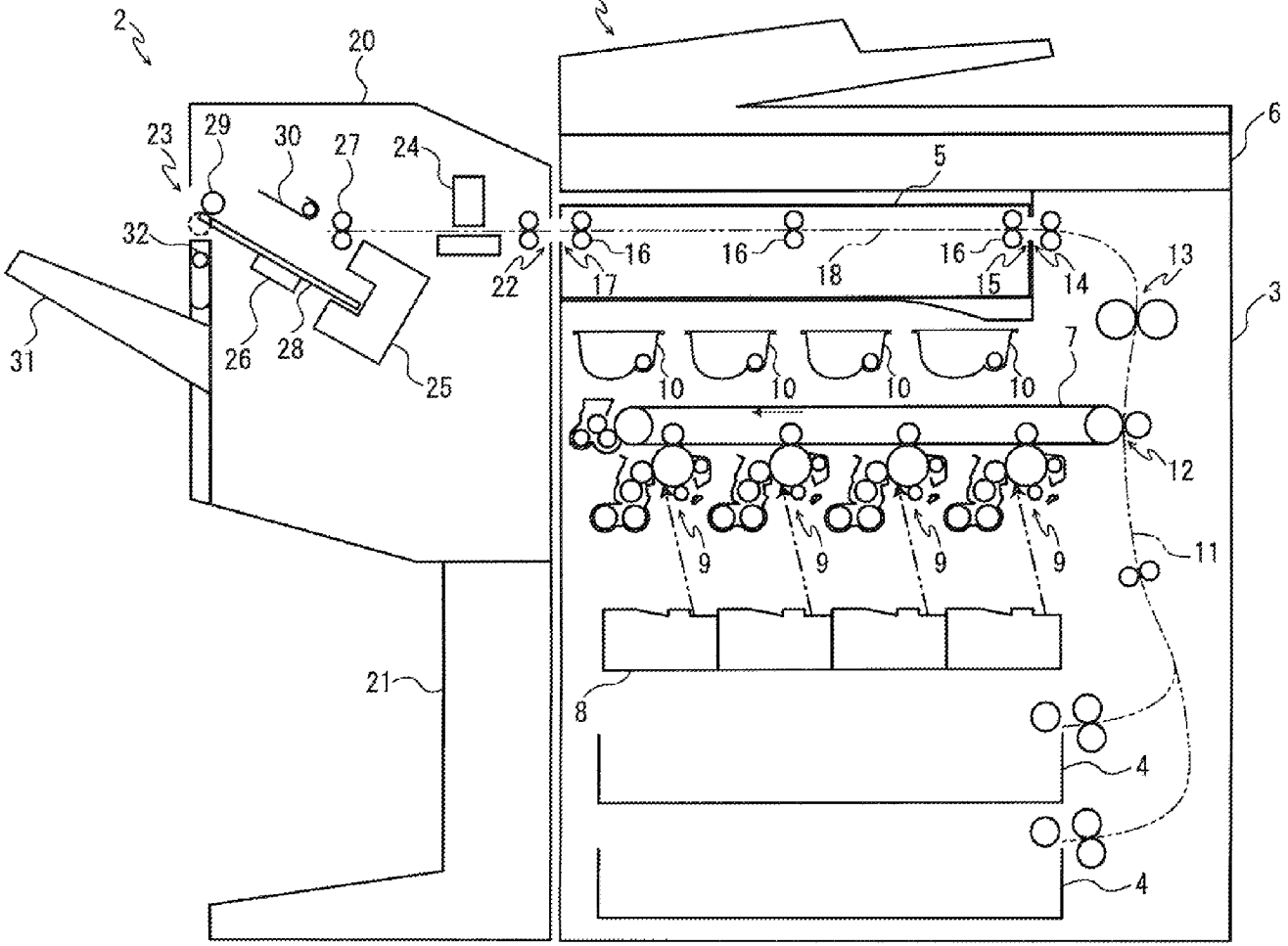
FIG. 1 is a sectional view schematically showing a post-processing device and a multifunction peripheral including this post-processing device according to an embodiment of the present disclosure.

In the following, with reference to the drawings, an embodiment of the present disclosure will be described. In the below-described embodiment, an image forming system includes an image forming apparatus performing image forming process to a sheet and a post-processing device according to the present disclosure. To a multifunction peripheral 1 as the image forming apparatus, the post-processing device 2 according to the present disclosure is applied. In the following, it will be described so that the front side of the plane of FIGS. 1 and 3-7 correspond to the front side of the multifunction peripheral 1. An arrow Fr in FIG. 2 indicates the front side of the multifunction peripheral 1. FIG. 1 is a sectional view schematically showing the post-processing device and the multifunction peripheral including this post-processing device according to the embodiment of the present disclosure. The post-processing device 2 is located to a left side (another side) of the multifunction peripheral 1.

First, the multifunction peripheral 1 will be described. As shown in FIG. 1, the multifunction peripheral 1 includes a roughly box-formed multifunction peripheral main body 3. In a lower part of the multifunction peripheral main body 3, a sheet feeding cassette 4 storing sheets (not shown) is installed. In an upper part of the multifunction peripheral main body 3, an in-body sheet ejection space is arranged. In the in-body sheet ejection space, a relaying unit 5 constituting a conveying path of the sheet between the multifunction peripheral 1 and post-processing device 2. On the multifunction peripheral main body 3, an image reading device 6 including a reading part and a document feeding part is arranged to read a display object of a document as image data.

In a center part of the multifunction peripheral main body 3, an intermediate transferring belt 7 is bridged over a plurality of rollers. Below the intermediate transferring belt 7, an exposing part 8 composed of a laser scanning unit (LSU) and others is installed. Near the intermediate transferring belt 7, four image forming parts 9 are installed for respective toner colors (for example, four colors of magenta, cyan, yellow and black) along a lower part of the intermediate transferring belt 7. Each image forming part 9 is configured so that, around a photosensitive drum, a charging part, a developing part, a first transferring part, a cleaning part and a static eliminating part are located. Above each developing part, a toner container 10 containing a toner of the correspondent toner color is installed.

At one side (the right-hand side of the figure) in the multifunction peripheral main body 3, a conveying path 11 of the sheet is arranged. At an upstream end of the conveying path 11, the sheet feeding cassette 4 is positioned. At an intermediate stream part of the conveying path 11, a second transferring part 12 including a part of the intermediate transferring belt 7 is positioned. At a downstream part of the conveying path 11, a fixing part 13 is positioned. At a downstream end of the conveying path 11, a multifunction peripheral sheet ejection port 14 is positioned.

Next, the relaying unit 5 will be described. The relaying unit 5 includes a relaying sheet feeding port 15, a plurality of relaying feeding rollers 16 and a relaying sheet ejection port 17. The relaying sheet feeding port 15 and relaying sheet ejection port 17 are formed so as to respectively open one end (a right side) and another end (the left side) of the relaying unit 5.

The relaying sheet feeding port 15 is located at a position corresponding to the multifunction peripheral sheet ejection port 14 of the multifunction peripheral main body 3 when the relaying unit 5 is installed to the multifunction peripheral main body 3. The plurality of the relaying feeding rollers 16 constitutes a relaying path 18 of the sheet from the relaying sheet feeding port 15 to the relaying sheet ejection port 17. The relaying sheet ejection port 17 is located at a left lateral face of the multifunction peripheral main body 3 when the relaying unit 5 is installed to the multifunction peripheral main body 3.

Figure 2:
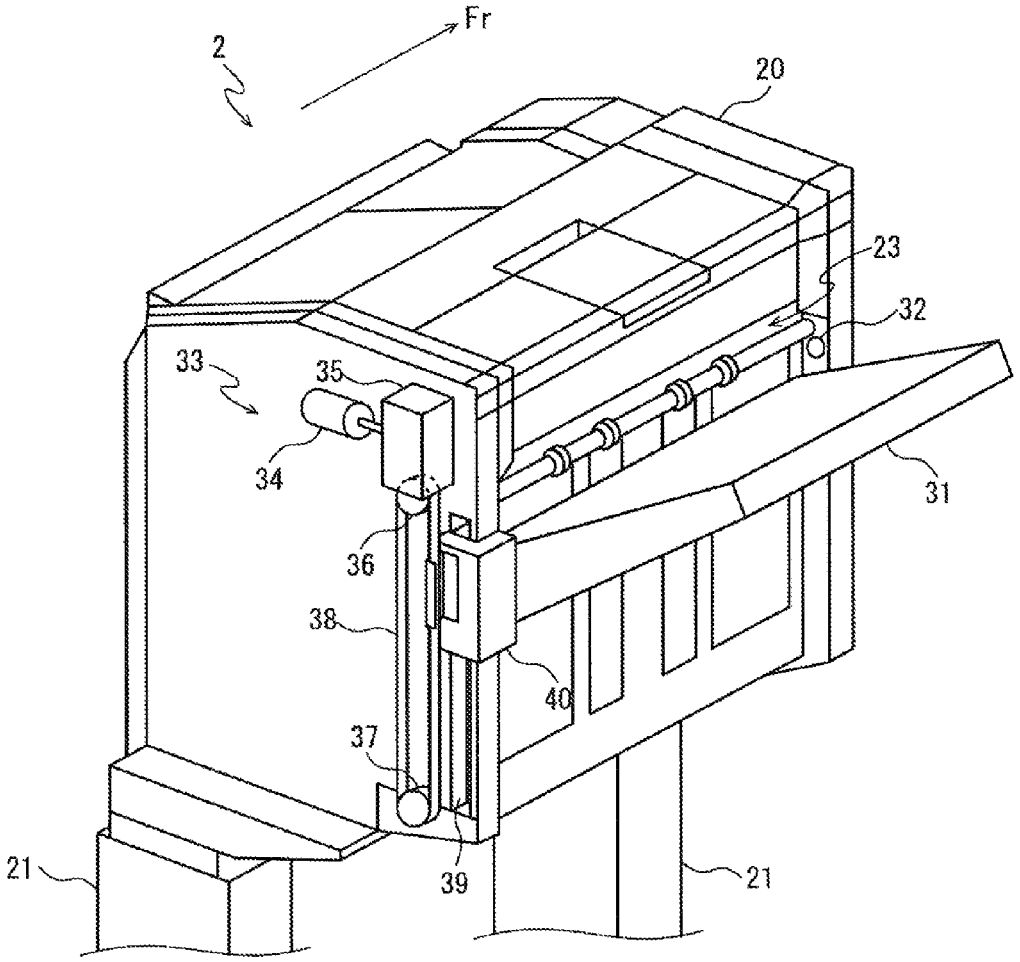
FIG. 2 is a perspective view partially showing the post-processing device according to the embodiment of the present disclosure.

Next, the post-processing device 2 will be described with reference to FIGS. 1 and 2. FIG. 2 is a perspective view partially showing the post-processing device according to the embodiment of the present disclosure. The post-processing device 2 is attached to the left side of the multifunction peripheral main body 3.

The post-processing device 2 includes a roughly box-formed device main body 20. Below the device main body 20, leg parts 21 are arranged. That is, the device main body 20 is supported by the leg parts 21.

The device main body 20 includes a post-processing sheet feeding port 22 and a post-processing sheet ejection port (a sheet ejection port) 23. The post-processing sheet feeding port 22 and post-processing sheet ejection port 23 are formed so as to respectively open one end (the right side) and another end (the left side) of the device main body 20.

Inside the device main body 20, a punching part 24, a stapling part 25 and a shifting part 26 are arranged in this order along a conveying path of the sheet from the post-processing sheet feeding port 22 to the post-processing sheet ejection port 23. The punching part 24 carries out punching process boring a punched hole in the sheet. The stapling part 25 carries out stapling process stapling every a predetermined number of the sheets. The shifting part 26 carries out shifting process shifting every one sheet or every one sheaf of the sheets in a width direction to adjust a position in the width direction of each sheet. The stapling part 25 and shifting part 26 works as a placed sheet processing part carrying out the stapling process and shifting process to the sheet in a state of being placed on a processing tray 28 mentioned below. The device main body 20 may include a sheet folding part carrying out folding process of the sheet or a mechanism having another post-processing function.

In addition, inside the device main body 20, conveying rollers 27, the processing tray 28 and sheet ejecting rollers 29 are arranged along the conveying path of the sheet and, above the processing tray 28, an aligning member 30 is arranged. The conveying rollers 27 and sheet ejecting rollers 29 work as a sheet conveying part. The aligning member 30 is configured, for example, so as to come into contact with the sheet conveyed from the conveying rollers 27 and to move and align a rear end of the sheet to a side of the stapling part 25 on the processing tray 28, when carrying out the stapling process or shifting process by the placed sheet processing part.

The conveying rollers 27 are positioned at a downstream side from the punching part 24 and at an upstream side from the stapling part 25 and shifting part in the conveying path of the sheet. The conveying rollers 27 convey the sheet conveyed directly from the post-processing sheet feeding port 22 (the sheet not processed by the punching part 24) or the sheet processed by the punching part 24 to the downstream side.

The processing tray 28 is positioned at the downstream side from the conveying rollers 27 in the conveying path of the sheet. On the processing tray 28, the sheet to be processed by the placed sheet processing part composed of the stapling part 25, shifting part 26 and others is temporarily placed. One end of the processing tray 28 is positioned at a side of the post-processing sheet ejection port 23 and another end of the processing tray 28 is positioned at a side of the stapling part 25. The rear end of the sheet is put in contact with the other end of the processing tray 28, and thereby, the rear end of the sheet is aligned.

The sheet ejecting rollers 29 are positioned at a side of the one end of the processing tray 28 and configured so as to eject every one sheet or every one sheaf composed of the predetermined number of the sheets placed on the processing tray 28. The sheet ejecting rollers 29 are constructed, for example, as a pair of the sheet ejecting rollers 29 interposing the sheet placed on the processing tray 28 from an upper side and a lower side so that these sheet ejecting rollers 29 are rotated to eject the sheet. The pair of the sheet ejecting rollers 29 are configured so that one sheet ejecting roller 29 can be moved to be separated from and to come into pressure contact with the other sheet ejecting roller 29. The one sheet ejecting roller 29 is separated from the other sheet ejecting roller 29, when placing the sheet onto the processing tray 28. The one sheet ejecting roller 29 comes into pressure contact with the other sheet ejecting roller 29, when ejecting the sheet placed on the processing tray 28, so as to interpose the sheet by an appropriate nip pressure according to the number of the sheets to be ejected. For example, the pair of the sheet ejecting rollers 29 also may come into pressure contact with the sheet and eject the sheet, in a case ejecting the sheet without carrying out the processes by the placed sheet processing part composed of the stapling part 25, shifting part 26 and others.

Outside the device main body 20, a stack tray 31 stacking the sheet ejected from the post-processing sheet ejection port 23 is arranged so as to protrude outwardly from a left lateral face of the device main body 20. The stack tray 31 is attached movable in upward and downward directions by a stack tray driving part 33 (refer to FIG. 2). A moving path of the stack tray 31 is arranged to extend in the upward and downward directions below the post-processing sheet ejection port 23. The stack tray 31 is located, for example, at an original position when the post-processing device 2 is in an original state or in a state not yet stacking the sheet. A level of the original position may be equal to an upper end of the moving path of the stack tray 31.

In addition, outside the device main body 20, a detecting part 32 is arranged. The detecting part 32 detects whether or not a top face of the stack tray 31 or a top face of the sheet stacked on the stack tray 31 is positioned at a detected position near the post-processing sheet ejection port 23. For example, a level of the detected position is set approximately equal to the level of the original position of the stack tray 31 and the detecting part 32 is arranged near the upper end of the moving path of the stack tray 31. The detecting part 32 includes a light emitting part (not shown) emitting a detecting light and a light receiving part (not shown) receiving the detecting light. The light emitting part and light receiving part are arranged so as to face to each other across the detected position.

The stack tray driving part 33 is arranged, as shown in FIG. 2, in a rear part of the device main body 20. The stack tray driving part 33 includes, for example, a drive source 34, such as a motor, a gear box 35, an upper side pulley 36, a lower side pulley 37, a driving belt 38, a guide part 39 and an attachment part 40.

The stack tray driving part 33 runs every time the predetermined number of the sheets or a sheet sheaf are/is ejected from the post-processing sheet ejection port 23 onto the stack tray 31. Concretely, the stack tray driving part 33 temporarily moves downwardly (lowers) the stack tray 31 until the detecting part 32 cannot detect the stack tray 31 or the sheet stacked on the stack tray 31, when the predetermined number of the sheets or a sheet sheaf are/is ejected onto the stack tray 31. After the stack tray 31 is moved downwardly and stopped, the stack tray driving part 33 moves upwardly (raises) the stack tray 31 until the detecting part 32 can detect the top face of the stack tray 31 or the top face of the sheet stacked on the stack tray 31. The stack tray driving part repeats the above-mentioned lowering and raising operations of the stack tray 31 while the sheet or sheet sheaf is ejected onto the stack tray 31.

The gear box 35 includes a plurality of gears (not shown) and is connected to the drive source 34 and upper side pulley 36. The plurality of gears of the gear box 35 are meshed so as to convert drive force from the drive source 34 to rotation of the upper side pulley 36. The plurality of gears of the gear box 35 have a speed reduction gear and are configured so as to adjust rotating speed of the upper side pulley 36.

The upper side pulley 36 is arranged above an uppermost position of the moving path of the stack tray 31 and the lower side pulley 37 is arranged below a lowermost position of the moving path of the stack tray 31. The driving belt 38 is wound around the upper side pulley 36 and lower side pulley 37 and rotated according to the rotation of the upper side pulley 36.

The guide part 39 is formed so as to extend in the upward and downward direction along the driving belt 38. To the attachment part 40, the stack tray 31 is attached. The attachment part 40 is attached so as to be fixed to the driving belt 38 and to be engaged with the guide part 39. The attachment part 40 is moved in the upward and downward direction along the guide part 39 in accordance with the rotation of the driving belt 38. For example, the guide part 39 is configured as a guide rail with a concave formed section and the attachment part 40 is configured to have a projected shape inserting into the concave formed portion of the guide part 39.

Figure 3:
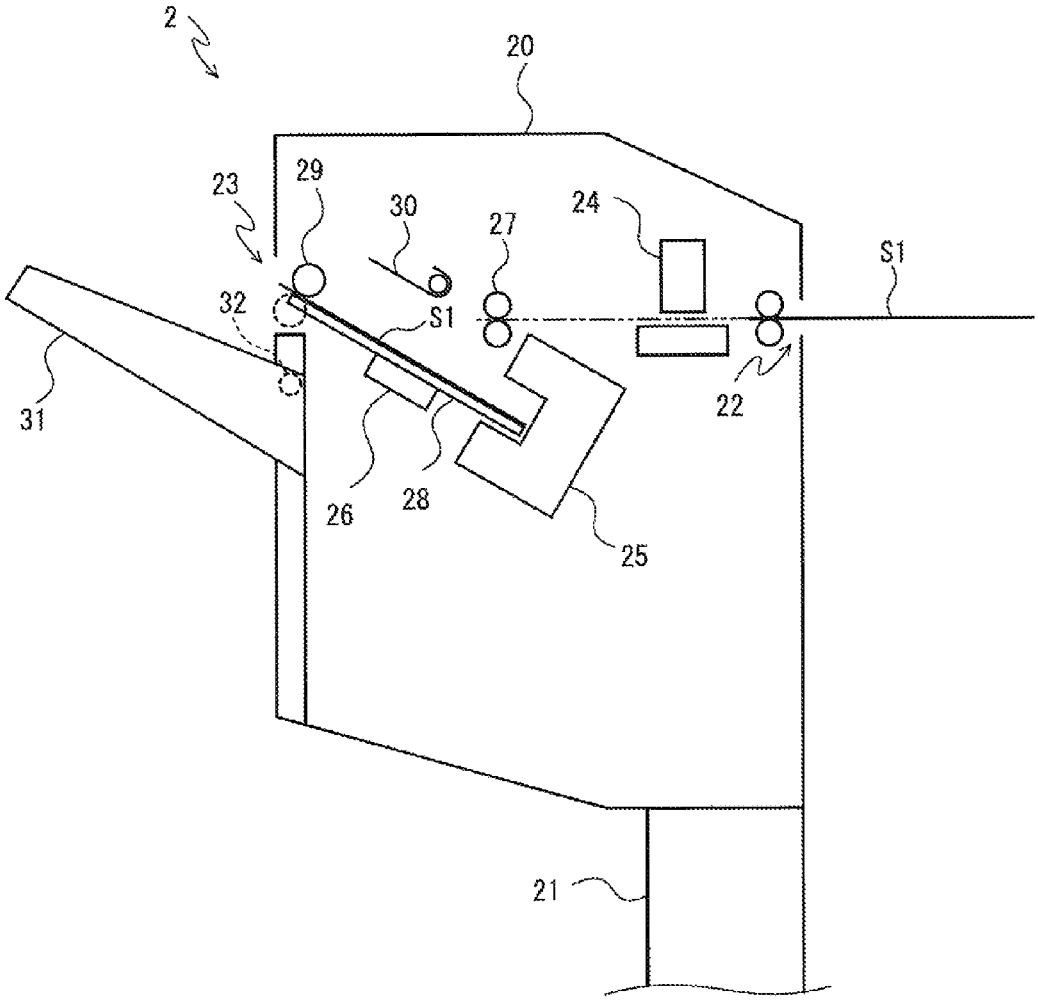
FIG. 3 is a sectional view schematically showing the post-processing device, in a situation where a stack tray is located at an original position, according to the embodiment of the present disclosure.
Figure 4:
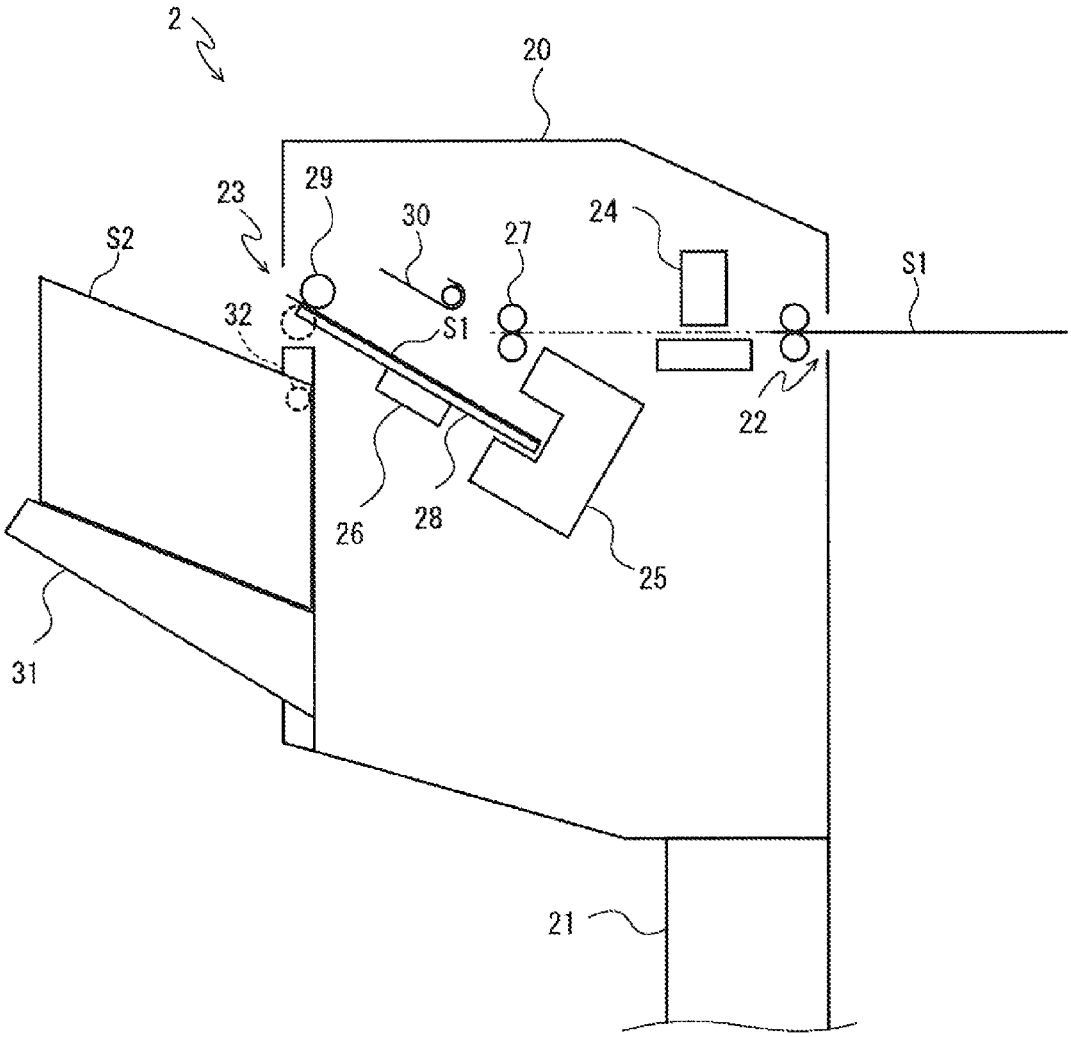
FIG. 4 is a sectional view schematically showing the post-processing device, in a situation where a plurality of sheets are stacked on the stack tray, according to the embodiment of the present disclosure.
Figure 5:
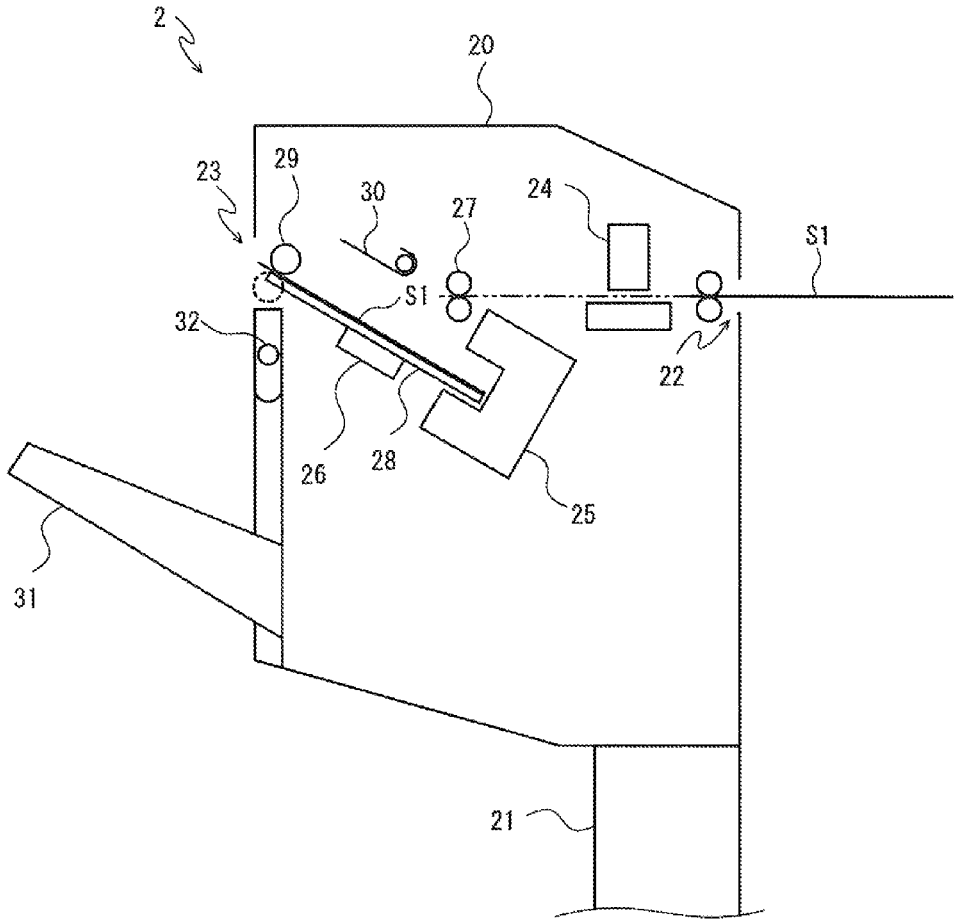
FIG. 5 is a sectional view schematically showing the post-processing device, in a situation where the plurality of sheets are taken out from the stack tray, according to the embodiment of the present disclosure.
Figure 6:
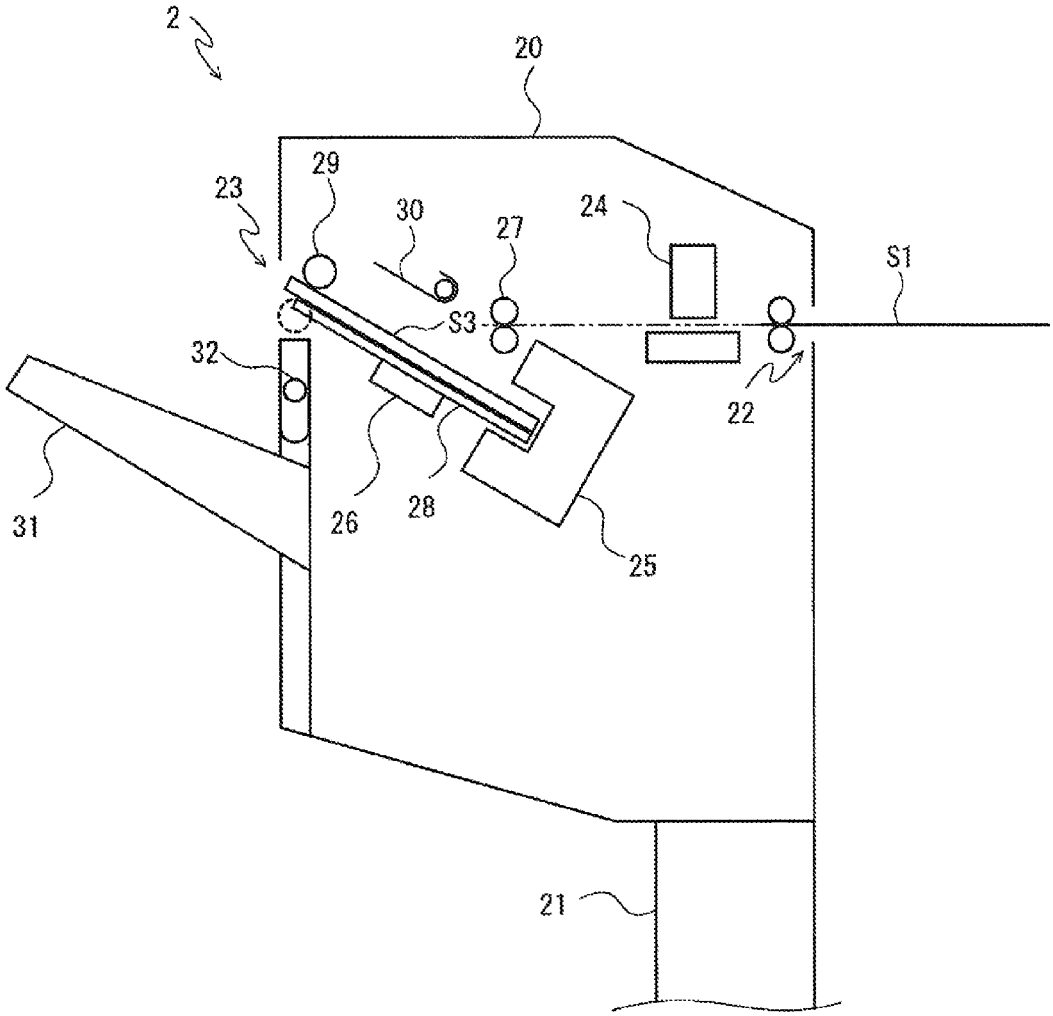
FIG. 6 is a sectional view schematically showing the post-processing device, in a situation in the middle of raising the stack tray to the original position, according to the embodiment of the present disclosure.
Figure 7:
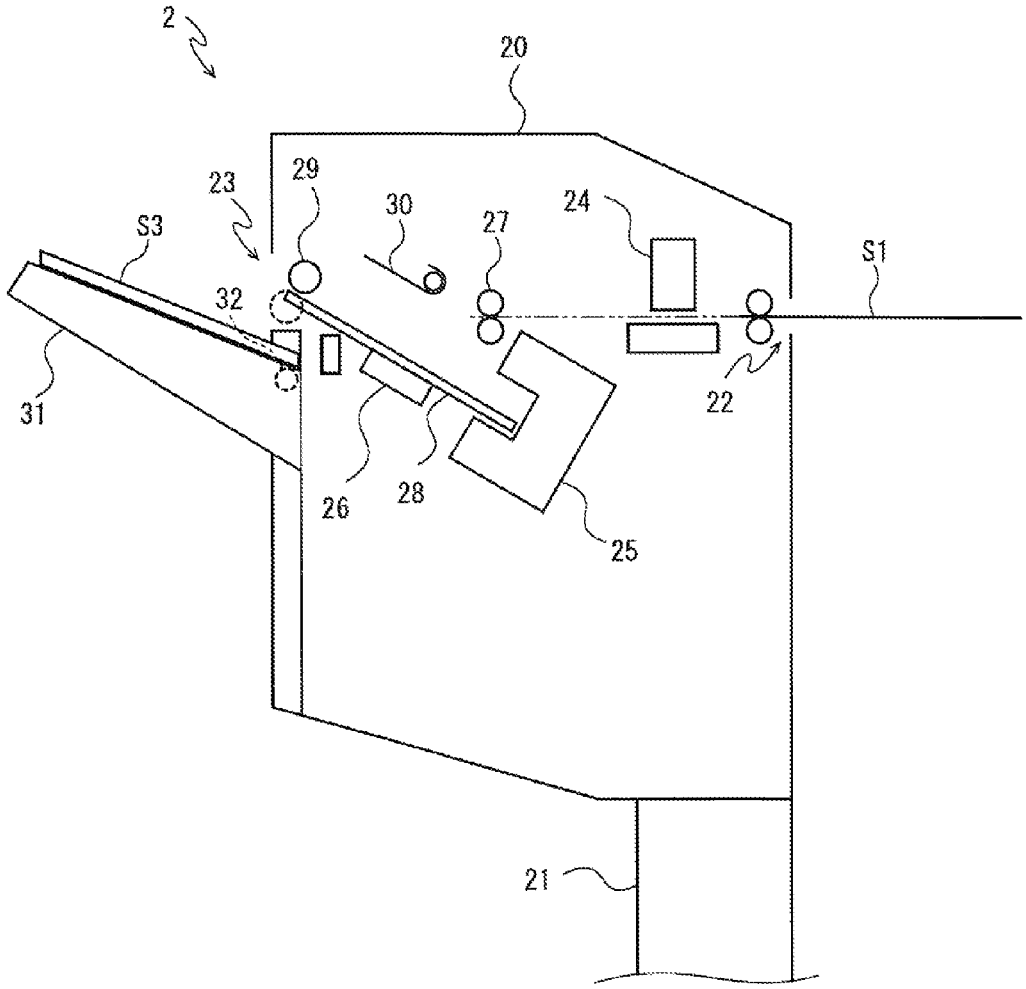
FIG. 7 is a sectional view schematically showing the post-processing device, in a situation where the stack tray has been returned to the original position, according to the embodiment of the present disclosure.

Next, the operation of ejecting the sheet by the post-processing device 2 with such a configuration will be described with reference to FIGS. 3-7. FIG. 3 is a schematic diagram illustrating a situation, where the stack tray is located at the original position, in the post-processing device according to the embodiment of the present disclosure. FIG. 4 is a schematic diagram illustrating a situation, where the plurality of the sheets are stacked on the stack tray, in the post-processing device according to the embodiment of the present disclosure. FIG. 5 is a schematic diagram illustrating a situation, where the plurality of sheets are taken out from the stack tray, in the post-processing device according to the embodiment of the present disclosure. FIG. 6 is a schematic diagram illustrating a situation, where the stack tray is raising toward the original position, in the post-processing device according to the embodiment of the present disclosure. FIG. 7 is a schematic diagram illustrating a situation, where the stack tray has been returned to the original position, in the post-processing device according to the embodiment of the present disclosure.

In the post-processing device 2 in the original state, as shown in FIG. 3, since the stack tray 31 is located in the original position (the detected position), the detecting part 32 is detecting the top face of the stack tray 31. Therefore, the stack tray driving part 33 does not drive the stack tray 31 and the stack tray 31 is stopped at the original position.

When the post-processing device 2 runs, the post-processing device 2 performs the post-processes appropriately selected by a user to the sheet S1 supplied from the multi-function peripheral 1 via the post-processing sheet feeding port 22. First, the operation in a case of carrying out the stapling process and shifting process by the placed sheet processing part (a first post-processing operation) will be described. In this first post-processing operation, the sheet S1 conveyed directly from the post-processing sheet feeding port 22 (the sheet S1 not processed by the punching part 24) or the sheet S1 punching-processed by the punching part 24 is conveyed by the conveying rollers 27, and then, fed to the processing tray 28 (refer to FIG. 3). At this time, the pair of the sheet ejecting rollers 29 are separated from each other and the sheet S1 is placed on the processing tray 28 between pair of the sheet ejecting rollers 29. One sheet S1 or one sheaf of the sheets S1 is/are shifted to the side of the stapling part 25 by the aligning member 30, and then, the stapling process by the stapling part 25 and the shifting process by the shifting part 26 are carried out. After that, the pair of the sheet ejecting rollers 29 come into pressure contact with each other to interpose the sheet(s) S1 and to eject the sheet(s) S1 to the post-processing sheet ejection port 23. The sheet(s) S1 ejected to the post-processing sheet ejection port 23 is/are placed (stacked) on the stack tray 31 (refer to FIG. 4).

When such ejection process is done, the stack tray driving part 33 moves downwardly the stack tray 31 until the detecting part 32 cannot detect the stack tray 31 or the sheet stacked on the stack tray 31, every time the predetermined number of the sheets or a sheet sheaf are/is ejected onto the stack tray 31. Subsequently, when the stack tray 31 or the sheet stacked on the stack tray 31 is moved to at a position not detected by the detecting part 32, the stack tray driving part 33 moves upwardly the stack tray 31 until the detecting part 32 detects the top face of the stack tray 31 or the top face of the sheet stacked on the stack tray 31. Thus, it is possible to keep the top face of the stack tray 31 or the top face of the sheet stacked on the stack tray 31 at the same position (the detected position) always.

Next, the operation in a case of not carrying out the stapling process and shifting process by the placed sheet processing part (a second post-processing operation) will be described. In this second post-processing operation, the sheet S1 conveyed directly from the post-processing sheet feeding port 22 (the sheet S1 not processed by the punching part 24) or the sheet S1 punching-processed by the punching part 24 is conveyed on by one by the conveying rollers 27, and then, advanced to the ejection by the post-processing sheet ejection port 23 without placing on the processing tray 28 (refer to FIG. 3). At this time, since sheet S1 is not placed on the processing tray 28, the pair of the sheet ejecting rollers 29 come into pressure contact with each other so as to eject the sheet S1. The sheet S1 ejected from the post-processing sheet ejection port 23 is stacked on the stack tray 31 (refer to FIG. 4).

Subsequently, in a similar way to the first post-processing operation, according to the predetermined number of the sheets, the stack tray driving part 33 lowers the stack tray 31 until the detecting part 32 cannot detect the stack tray 31 or the sheet stacked on the stack tray 31, and then, the stack tray driving part 33 raises the stack tray 31 until the detecting part 32 detects the top face of the stack tray 31 or the top face of the sheet stacked on the stack tray 31.

If such a second post-processing operation is continued to a plurality of the sheets S2, as shown in FIG. 4, the plurality of the sheets S2 are stacked on the stack tray 31 and the stack tray 31 is moved lower than the original position by the stack tray driving part 33. At this time, the detecting part 32 detects the top face of the sheets S2 stacked on the stack tray 31.

While this second post-processing operation is continued, if the plurality of the sheets S2 are taken out from the stack tray 31 (refer to FIG. 5), the detecting part 32 cannot detect either of the stack tray 31 and the sheet at the detected position (incidentally, depending on the number of the taken-out sheets, the detecting part 32 may continue to detect the stack tray 31 or sheet). In such a case where the detecting part 32 cannot detect either of the stack tray 31 and the sheet at the detected position, the stack tray driving part 33 raises the stack tray 31 until the detecting part 32 detects the stack tray 31 or the sheet at the detected position.

Even if the sheet is taken out from the stack tray 31 and the stack tray 31 is raised while the second post-processing operation is continued as mentioned above, the sheet S1 supplied from the post-processing sheet feeding port 22 is conveyed via the conveying rollers 27 directly or after the punching process by the punching part 24. The sheet S1 conveyed from the conveying rollers 27 during the raising of the stack tray 31 is fed to the processing tray 28 before being ejected onto on the stack tray 31 via the post-processing sheet ejection port 23. When the stack tray 31 is raised, the pair of the sheet ejecting rollers 29 are separated from each other. Therefore, the sheet S1 fed to the processing tray 28 is placed on the processing tray 28 between the pair of the separated sheet ejecting rollers 29. The sheet S1 placed on the processing tray 28 is shifted to the side of the stapling part 25 by the aligning member 30. Thus, until the detecting part 32 detects the top face of the stack tray 31 or the top face of the sheet stacked on the stack tray 31, a plurality of the sheets S3 conveyed by the conveying rollers 27 are temporarily placed on the processing tray 28 (refer to FIG. 6).

Subsequently, after the stack tray 31 or the sheet stacked on the stack tray 31 is moved to the detected position by raising the stack tray 31, and then, the detecting part 32 detects the top face of the stack tray 31 or the top face of the sheet stacked on the stack tray 31, the stack tray driving part 33 stops the driving of the stack tray 31 (refer to FIG. 7).

When the raising of the stack tray 31 is thus finished, the pair of the sheet ejecting rollers 29 come into pressure contact with each other to interpose the plurality of the sheets S3 placed on the processing tray in a lump and to eject them to the post-processing sheet ejection port 23. The sheets S3 ejected from the post-processing sheet ejection port 23 are stacked on the stack tray 31. The stack tray driving part 33 drives and lowers the stack tray 31 in accordance with the number (height) of the ejected sheets S3. Concretely, the stack tray driving part 33 temporarily lowers the stack tray 31 until the detecting part 32 cannot detect the sheets S3 stacked on the stack tray 31. The stack tray driving part 33 lowers and stops the stack tray 31, and then, the stack tray driving part 33 raises the stack tray 31 until the detecting part 32 detects the top face of the sheets S3 stacked on the stack tray 31.

In accordance with the embodiment, as described above, the post-processing device 2 includes a device main body 20, a processing tray 28, a placed sheet processing part composed of the stapling part 25, shifting part 26 and others, a stack tray 31, a detecting part 32, a stack tray driving part 33 and a sheet conveying part composed of the conveying rollers 27 and sheet ejecting rollers 29. The device main body 20 includes the post-processing sheet ejection port 23 used for ejecting a sheet. The processing tray 28 is arranged inside the device main body 20, on which the sheet is temporarily placed. The placed sheet processing part carries out post-process to the sheet in a state of being placed on the processing tray 28. The stack tray 31 is arranged in the device main body 20 to stack the sheet ejected from the post-processing sheet ejection port 23. The detecting part 32 is arranged in the device main body 20 to detect whether or not a top face of the stack tray 31 or a top face of the sheet stacked on the stack tray 31 is positioned at a detected position below the post-processing sheet ejection port 23. The stack tray driving part 33 is configured so as to move downwardly the stack tray 31 until the detecting part 32 cannot detect the stack tray 31 or the sheet stacked on the stack tray 31, when the sheet is ejected from the post-processing sheet ejection port 23, and then, to move upwardly the stack tray 31 until the detecting part 32 detects the top face of the stack tray 31 or the top face of the sheet stacked on the stack tray 31. The stack tray driving part 33 also moves upwardly the stack tray 31 in a case where the detecting part 32 does not detect the stack tray 31 or the sheet stacked on the stack tray 31, when ejecting the sheet. The sheet conveying part is configured, when the sheet is ejected without the post-process by the placed sheet processing part, in a case where the detecting part 32 detects the stack tray 31 or the sheet stacked on the stack tray 31, so as to eject the sheet from the post-processing sheet ejection port 23 without placing on the processing tray 28. The sheet conveying part also is configured, when the sheet is ejected without the post-process by the placed sheet processing part, in another case where the detecting part 32 does not detect the stack tray 31 or the sheet stacked on the stack tray 31, to stop the ejection of the sheet to the stack tray 31 and to place the sheet on the processing tray 28 until the detecting part 32 detects the stack tray 31 or the sheet stacked on the stack tray 31, and then, to eject the sheet placed on the processing tray 28 from the post-processing sheet ejection port 23 to the stack tray 31 after the detecting part 32 detects the stack tray 31 or the sheet stacked on the stack tray 31.

By applying such a configuration, even if the sheet stacked on the stack tray 31 is taken out, the stack tray driving part 33 can locate the stack tray 31 so as to align the top face of the stack tray 31 or the top face of the sheet stacked on the stack tray 31 with the detected position near the post-processing sheet ejection port 23 always. Therefore, while the sheet conveyed directly from the post-processing sheet feeding port 22 (the sheet not processed by the punching part 24) or the sheet punching-processed by the punching part 24 is ejecting without the processes in the placed sheet processing part composed of the stapling part 25, shifting part 26 and others, even if the sheet already ejected and stacked on the stack tray 31 is taken out, since the following sheets are temporarily accumulated on the processing tray 28, it is possible to carry out the sheet ejection process after the stack tray 31 is located at an appropriate position, and then, to suitably stack the sheet on the stack tray 31.

Further, the post-processing device 2 does not stop the conveying operation of the sheet from the multifunction peripheral 1 and post-processing works of the sheet in the raising time of the stack tray 31. The post-processing device 2 also can immediately carry out the ejection of the sheet accumulated on the processing tray 28 after the raising of the stack tray 31. Therefore, even if the sheet is taken out from the stack tray 31 in the middle of the ejection of the sheet, no waste of working time occurs. That is, the post-processing device 2 can eject the sheet at an appropriate position always to stack the sheet on the stack tray 31 without stopping the conveying operation and post-processing works of the sheet.

In the embodiment, the detecting part 32 is arranged near the upper end of the moving path of the stack tray 31. Thereby, the detected position of the detecting part 32 is set near the upper end of the moving path of the stack tray 31 and the detecting part 32 can achieve the detection according to the movement of the stack tray 31.

In the embodiment, the detecting part 32 includes the light emitting part emitting the detecting light and the light receiving part receiving the detecting light and the light emitting part and light receiving part are arranged so as to face to each other across the detected position. Thereby, the detecting part 32 can be applied to the post-processing device 2 without needing complicated structure.

Although, in the embodiment, the configuration of the post-processing device 2 independently provided from the multifunction peripheral 1 was described, in another embodiment, the post-processing device 2 is provided in the image forming apparatus, such as the multifunction peripheral 1, or configured so as to be united with the multifunction peripheral 1 or another image forming apparatus.

The embodiment was described in a case of applying the configuration of the present disclosure to the post-processing device 2 connected to the multifunction peripheral 1 as the image forming apparatus. On the other hand, in another embodiment, the configuration of the disclosure may be applied to another the post-processing device 2 connected to any of various image reading devices, such as a printer, copying machine or a facsimile.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A post-processing device comprising:

a device main body including a sheet ejection port used for ejecting a sheet and a sheet feeding port used for inputting the sheet from the outside;

a processing tray arranged inside the device main body to have one end at a side of the sheet ejection port, on which the sheet is temporarily placed;

a placed sheet processing part arranged at a side of another end of the processing tray and carrying out post-process to the sheet in a state of being placed on the processing tray;

a stack tray arranged in the device main body to stack the sheet ejected from the sheet ejection port;

a detecting part arranged in the device main body to detect whether or not a top face of the stack tray or a top face of the sheet stacked on the stack tray is positioned at a detected position below the sheet ejection port;

a stack tray driving part configured so as to move downwardly the stack tray until the detecting part cannot detect the stack tray or the sheet stacked on the stack tray, when the sheet is ejected from the sheet ejection port, and then, to move upwardly the stack tray until the detecting part detects the top face of the stack tray or the top face of the sheet stacked on the stack tray, and moreover, moving upwardly the stack tray in a case where the detecting part does not detect the stack tray or the sheet stacked on the stack tray, when ejecting the sheet;

a sheet conveying part arranged on a conveying path of the sheet from the sheet feeding port to the sheet ejection port; and an aligning member aligning the sheet placed on the processing tray, wherein the sheet conveying part has:

a conveying roller positioned at an upstream side from the placed sheet processing part in the conveying path of the sheet to convey the sheet ejected without the post-process of the placed sheet processing part to a downstream side in the conveying path; and a sheet ejecting roller positioned at a side of one end of the processing tray and ejecting every one sheet or every one sheaf composed of a predetermined number of the sheets placed on the processing tray, the sheet conveying part is configured, when the sheet is ejected with the post-process by the placed sheet processing part, so as to eject a post-processed sheet placed on the processing tray and aligned by the aligning member from the sheet ejection port to the stack tray and, when the sheet is ejected without the post-process by the placed sheet processing part, in a case where the detecting part detects the stack tray or the sheet stacked on the stack tray, so as to eject the sheet from the sheet ejection port without placing on the processing tray and, in another case where the detecting part does not detect the stack tray or the sheet stacked on the stack tray, to stop the ejection of the sheet to the stack tray and to place the sheet on the processing tray until the detecting part detects the stack tray or the sheet stacked on the stack tray, and then, to eject the sheet placed on the processing tray and aligned by the aligning member from the sheet ejection port to the stack tray after the detecting part detects the stack tray or the sheet stacked on the stack tray, the sheet ejecting roller is constructed as a pair of the rollers interposing the sheet placed on the processing tray from an upper side and a lower side, the pair of the rollers are configured so that one roller can be moved to be separated from and to come into pressure contact with another roller, the one roller is separated from the other roller when placing the sheet onto the processing tray, and the one roller comes into pressure contact with the other roller, when ejecting the sheet placed on the processing tray to the stack tray, so as to interpose the sheet by an appropriate nip pressure according to the number of the sheets to be ejected.

2. The post-processing device according to claim 1, wherein the stack tray is configured so as to move along a moving path extending in upward and downward directions below the sheet ejection port, the detecting part is arranged near an upper end of the moving path of the stack tray.

3. The post-processing device according to claim 1, wherein the detecting part includes a light emitting part emitting a detecting light and a light receiving part receiving the detecting light, and the light emitting part and light receiving part are arranged so as to face to each other across the detected position.

4. The post-processing device according to claim 1, wherein the placed sheet processing part has:

a stapling part carrying out stapling process stapling every a predetermined number of the sheets; and a shifting part carrying out shifting process shifting every one sheet or every one sheaf of the sheets in a width direction to adjust a position in the width direction of each sheet, one end of the processing tray is arranged a side of the sheet ejection port and another end of the processing tray is arranged a side of the stapling part.

5. An image forming system comprising:

an image forming apparatus performing image forming process to a sheet; and a post-processing device, wherein the post-processing device includes:

a device main body including a sheet ejection port used for ejecting a sheet and a sheet feeding port used for inputting the sheet from the outside;

a processing tray arranged inside the device main body to have one end at a side of the sheet ejection port, on which the sheet is temporarily placed;

a placed sheet processing part arranged at a side of another end of the processing tray and carrying out post-process to the sheet in a state of being placed on the processing tray;

a stack tray arranged in the device main body to stack the sheet ejected from the sheet ejection port;

a detecting part arranged in the device main body to detect whether or not a top face of the stack tray or a top face of the sheet stacked on the stack tray is positioned at a detected position below the sheet ejection port;

a stack tray driving part configured so as to move downwardly the stack tray until the detecting part cannot detect the stack tray or the sheet stacked on the stack tray, when the sheet is ejected from the sheet ejection port, and then, to move upwardly the stack tray until the detecting part detects the top face of the stack tray or the top face of the sheet stacked on the stack tray, and moreover, moving upwardly the stack tray in a case where the detecting part does not detect the stack tray or the sheet stacked on the stack tray, when ejecting the sheet;

a sheet conveying part arranged on a conveying path of the sheet from the sheet feeding port to the sheet ejection port; and an aligning member aligning the sheet placed on the processing tray, wherein the sheet conveying part has:

a conveying roller positioned at an upstream side from the placed sheet processing part in the conveying path of the sheet to convey the sheet ejected without the post-process of the placed sheet processing part to a downstream side in the conveying path; and a sheet ejecting roller positioned at a side of one end of the processing tray and ejecting every one sheet or every one sheaf composed of a predetermined number of the sheets placed on the processing tray, the sheet conveying part is configured, when the sheet is ejected with the post-process by the placed sheet processing part, so as to eject a post-processed sheet placed on the processing tray and aligned by the aligning member from the sheet ejection port to the stack tray and, when the sheet is ejected without the post-process by the placed sheet processing part, in a case where the detecting part detects the stack tray or the sheet stacked on the stack tray, so as to eject the sheet from the sheet ejection port without placing on the processing tray and, in another case where the detecting part does not detect the stack tray or the sheet stacked on the stack tray, to stop the ejection of the sheet to the stack tray and to place the sheet on the processing tray until the detecting part detects the stack tray or the sheet stacked on the stack tray, and then, to eject the sheet placed on the processing tray and aligned by the aligning member from the sheet ejection port to the stack tray after the detecting part detects the stack tray or the sheet stacked on the stack tray, the sheet ejecting roller is constructed as a pair of the rollers interposing the sheet placed on the processing tray from an upper side and a lower side, the pair of the rollers are configured so that one roller can be moved to be separated from and to come into pressure contact with another roller, the one roller is separated from the other roller when placing the sheet onto the processing tray, and the one roller comes into pressure contact with the other roller, when ejecting the sheet placed on the processing tray to the stack tray, so as to interpose the sheet by an appropriate nip pressure according to the number of the sheets to be ejected.

6. The image forming system according to claim 5, wherein the stack tray is configured so as to move along a moving path extending in upward and downward directions below the sheet ejection port, the detecting part is arranged near an upper end of the moving path of the stack tray.

7. The image forming system according to claim 5, wherein the detecting part includes a light emitting part emitting a detecting light and a light receiving part receiving the detecting light, and the light emitting part and light receiving part are arranged so as to face to each other across the detected position.

8. The image forming system according to claim 5, wherein the placed sheet processing part has:

a stapling part carrying out stapling process stapling every a predetermined number of the sheets; and a shifting part carrying out shifting process shifting every one sheet or every one sheaf of the sheets in a width direction to adjust a position in the width direction of each sheet, one end of the processing tray is arranged a side of the sheet ejection port and another end of the processing tray is arranged a side of the stapling part.

* * * * *